US010641563B2

(12) United States Patent
Song et al.

(10) Patent No.: US 10,641,563 B2
(45) Date of Patent: May 5, 2020

(54) FIREARM RECEIVER AND A METHOD OF MANUFACTURING IT

(71) Applicant: Tinwgu Song, Palos Verdes, CA (US)

(72) Inventors: Tingwu Song, Palos Verdes, CA (US); Paul T. Noonan, Boise, ID (US)

(73) Assignee: Tingwu Song

( * ) Notice: Subject to any disclaimer, the term of this patent is extended or adjusted under 35 U.S.C. 154(b) by 46 days.

(21) Appl. No.: 16/132,734

(22) Filed: Sep. 17, 2018

(65) Prior Publication Data

US 2019/0086168 A1 Mar. 21, 2019

Related U.S. Application Data

(60) Provisional application No. 62/560,054, filed on Sep. 18, 2017.

(51) Int. Cl.
*F41A 3/66* (2006.01)
*F41A 3/84* (2006.01)

(52) U.S. Cl.
CPC . *F41A 3/66* (2013.01); *F41A 3/84* (2013.01)

(58) Field of Classification Search
CPC ..... F41A 3/66; F41A 3/84; F41A 11/00
See application file for complete search history.

(56) References Cited

U.S. PATENT DOCUMENTS

2014/0331535 A1* 11/2014 Robinson ..... F41A 3/66 42/6
2015/0052794 A1* 2/2015 Underwood ..... F41A 3/66 42/16
2017/0241724 A1* 8/2017 Lammers ..... F41A 5/26
2019/0301821 A1* 10/2019 Song ..... F41A 3/66

* cited by examiner

*Primary Examiner* — J. Woodrow Eldred

(57) ABSTRACT

A receiver and a method for manufacturing it are disclosed. The receiver contains an incomplete receiver containing a first receiver opening configured to accommodate an ammunition magazine, a second receiver opening containing a first and a second protrusion, a buffer tube insert containing an upwardly extending lobe, a first side panel positioned within the second receiver opening, the first side panel containing a first panel opening configured to accommodate the first protrusion, a second side panel positioned within the receiver second opening, the second side panel containing a second panel opening configured to accommodate the second protrusion.

9 Claims, 7 Drawing Sheets

FIREARM RECEIVER AND A METHOD OF MANUFACTURING IT

CROSS REFERENCE TO RELATED APPLICATIONS

This application claims the benefit of U.S. Provisional Application No. 62/560,054, filed on Sep. 18, 2017, which is incorporated herein by reference in its entirety.

FIELD

The present invention relates to firearm manufacture. More particularly, the present invention relates to a firearm receiver and a method of manufacturing it.

BACKGROUND

Firearm receiver is a part of a firearm that provides housing for a hammer, a bolt and/or a firing mechanism. Unfinished receivers, also referred to as 80% receivers, are only about 80% completed. It is up to a customer to finish manufacturing a firearm by performing the remaining 20% of the drilling and/or milling. Due to complexities involved, many customers do not have the equipment and/or knowledge to properly manufacture the last 20% of the firearm receiver.

Therefore, there is a need for a firearm receiver and a method of manufacturing it such that a customer can easily finish manufacturing the last 20% of the firearm.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 1:
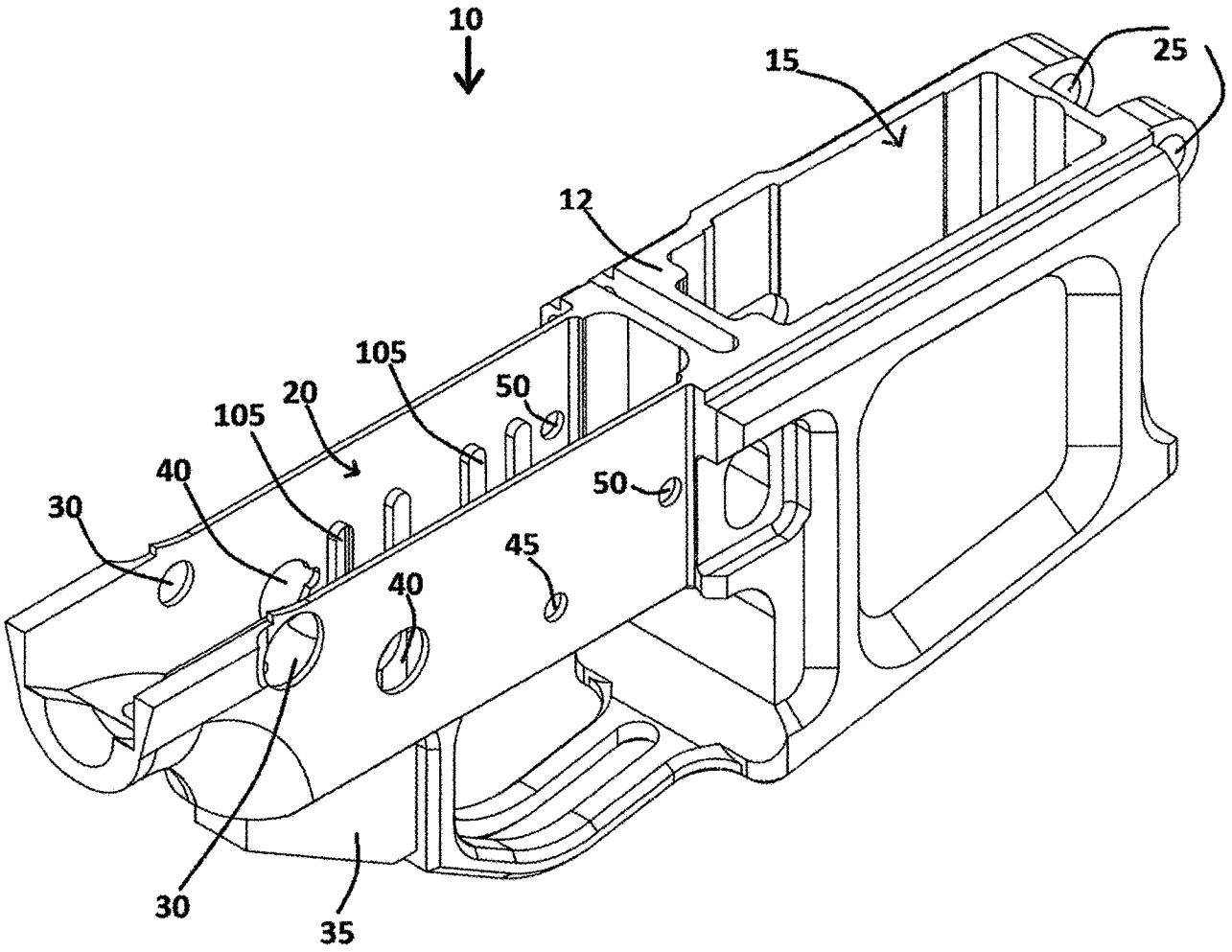
FIG. 1 depicts an incomplete receiver according to the present disclosure.

Referring to FIG. 1, an incomplete receiver 10 for a firearm is shown according to the present disclosure. The incomplete receiver 10 may comprise a generally flat top surface 12 configured with openings for accepting the internal mechanisms required to operate the rifle. For example, the incomplete receiver 10 may comprise an opening 15 configured to accept an ammunition magazine (not shown) and associated hardware to direct rounds loaded within the magazine into a chamber in an upper receiver (not shown). The incomplete receiver 10 may also comprise an opening 20. According to some embodiments, the opening 20 is too large to accommodate a standard firing mechanism (i.e. standard trigger group). According to some embodiments, the standard firing mechanism (i.e. standard trigger group) comprises a trigger mechanism and a hammer mechanism.

According to some embodiments, the incomplete receiver 10 comprises through-holes 25 configured to align with a respective through-holes of an upper receiver (not shown) whereby a pin is inserted into and passes within each through-hole to secure the incomplete receiver 10 with the upper receiver (not shown). According to some embodiments, the incomplete receiver 10 comprises through-holes 30 configured to align with a respective through-holes of an upper receiver (not shown) whereby a pin 31 (shown in FIG. 3) is inserted into and passes within each through-hole to secure the incomplete receiver 10 with the upper receiver (not shown).

According to some embodiments, the incomplete receiver 10 comprises safety-selector through-holes 40 whereby a pin 41 (shown in FIG. 3) is inserted into and passes within the safety-selector through-holes 40 to secure a safety selector mechanism inside the incomplete receiver 10. According to some embodiments, the incomplete receiver 10 comprises trigger through-holes 45 whereby a pin 46 (shown in FIG. 3) is inserted into and passes within the trigger through-holes 45 to secure a trigger mechanism inside the incomplete receiver 10. According to some embodiments, the incomplete receiver 10 comprises hammer through-holes 50 whereby a pin 51 (shown in FIG. 3) is inserted into and passes within the hammer through-holes 50 to secure a hammer mechanism inside the incomplete receiver 10. According to some embodiments, the incomplete receiver 10 comprises a grip mounting surface 35 for securing, for example, a pistol grip (not shown).

It is to be understood that the incomplete receiver 10 may be an AR-style lower receiver or any other type of a firearm receiver.

Figure 2:
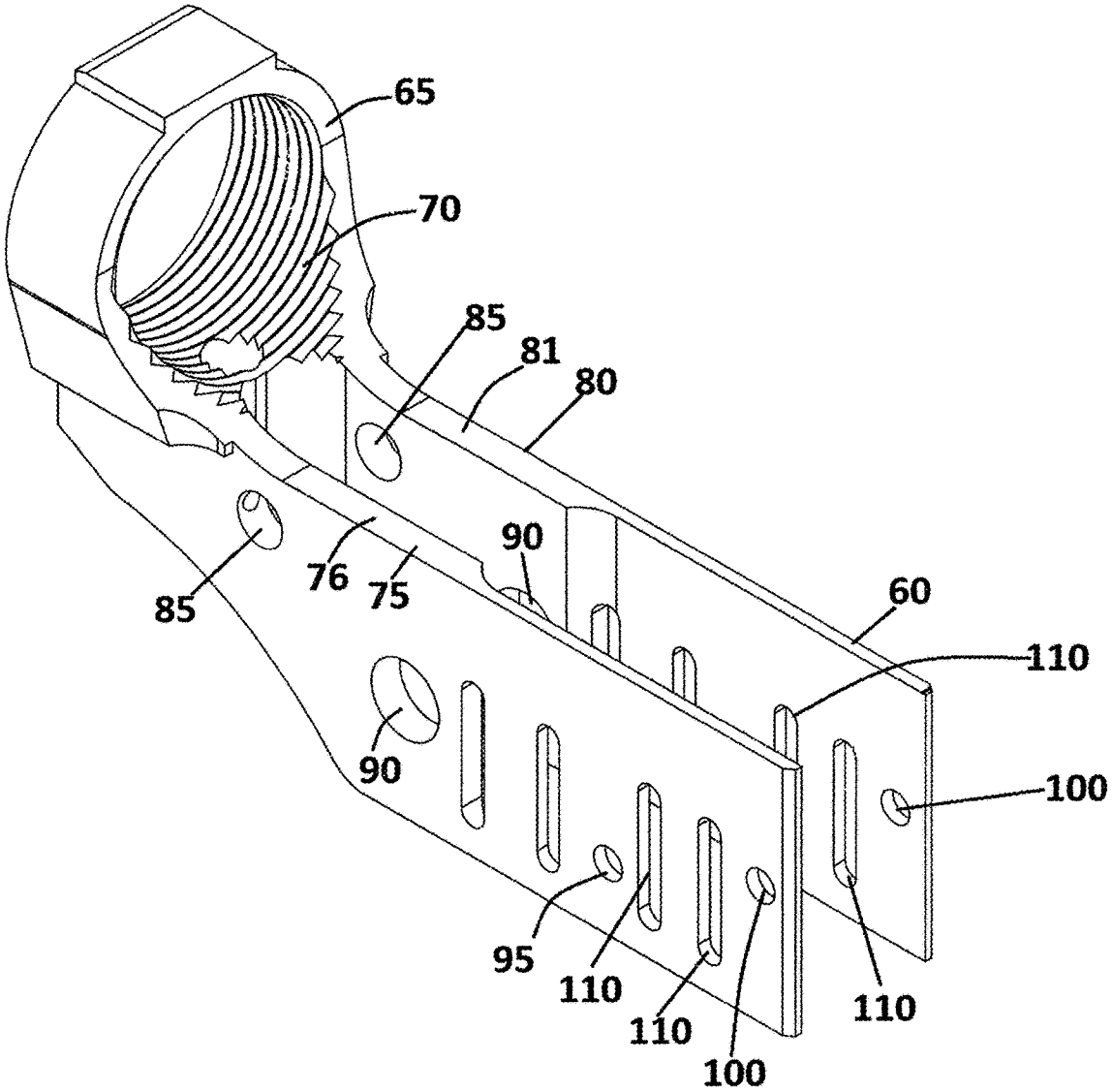
FIG. 2 depicts a buffer tube insert according to the present disclosure.

Referring to FIG. 2, a buffer tube insert 60 is shown according to the present disclosure. The buffer tube insert 60 comprises an upwardly extending lobe 65. According to some embodiments, the upwardly extending lobe 65 is used to mount a buttstock (not shown) to the buffer tube insert 60 and is used to align a receiver extension (not shown) with a bolt carrier housed within an upper receiver (not shown). The receiver extension (not shown) generally houses an action (or recoil) spring and a buffer assembly (not shown). Upon discharge of a round, the bolt carrier within the upper housing is driven rearward by action of the gas discharged by the firing action. The buffer assembly and action spring dampen the kickback experienced by a user while also redirecting the firing mechanism back toward the chamber in preparation for firing another round.

According to some embodiments, the upwardly extending lobe 65 comprises a generally circular threaded through-hole 70 adapted to receive the mating male threads on the receiver extension (not shown).

According to some embodiments, the buffer tube insert 60 comprises a first side panel 75 and a second side panel 80. According to some embodiments, the upwardly extending lobe 65 is coupled with the first side panel 75 and the second side panel 80. According to some embodiments, the upwardly extending lobe 65 is integrally coupled with the first side panel 75 and the second side panel 80. According to some embodiments, the upwardly extending lobe 65 is substantially perpendicular to the first side panel 75 and the second side panel 80. According to some embodiments, the upwardly extending lobe 65 forms a generally 90 degree elbow with the first side panel 75 and the second side panel 80.

According to some embodiments, the first side panel 75 and the second side panel 80 are a first distance apart. According to some embodiments, the first distance is sufficient enough to accommodate a standard firing mechanism (i.e. standard trigger group).

According to some embodiments, the first side panel 75 comprises a generally flat top surface 76. According to some embodiments, the second side panel 80 comprises a generally flat top surface 81.

Figure 3:
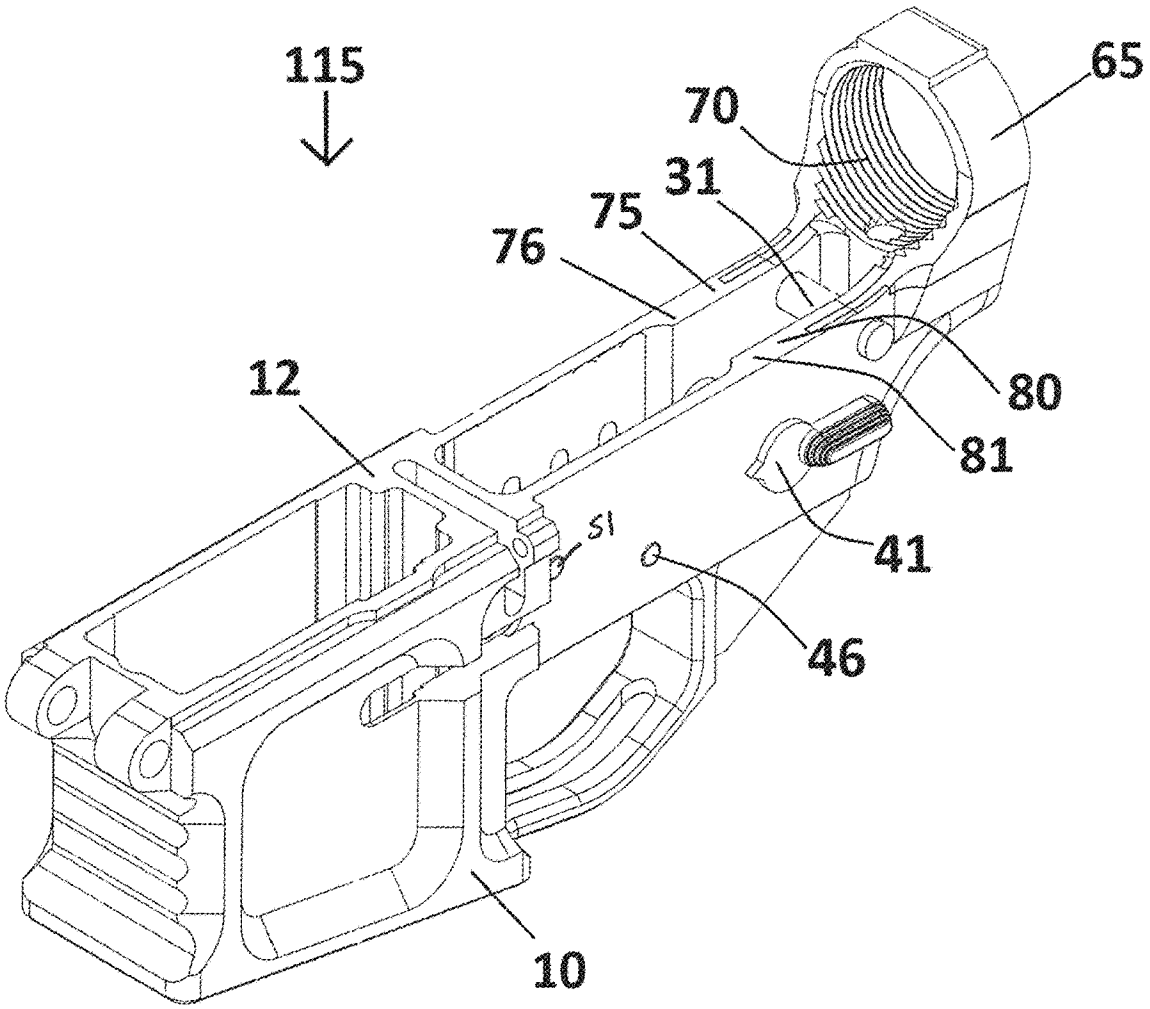
FIG. 3 depicts the incomplete receiver shown in FIG. 1 coupled with the buffer tube insert shown in FIG. 2.

According to some embodiments, the opening 20 is configured to accommodate the first side panel 75 and the second side panel 80 as shown in FIG. 3. According to some embodiments, the flat top surface 76 and the flat top surface 81 lineup with the top surface 12.

According to some embodiments, the first side panel 75 and the second side panel 80 comprise through-holes 85 configured to align with a respective through-holes 30 of the incomplete receiver 10 whereby the pin 31 is inserted into and passes within each through-hole 30, 85 to secure the incomplete receiver 10 with the first side panel 75 and the second side panel 80. According to some embodiments, the first side panel 75 and the second side panel 80 comprise safety-selector through-holes 90 configured to align with a respective safety-selector through-holes 40 of the incomplete receiver 10 whereby the pin 41 is inserted into and passes within each safety-selector through-holes 40, 90 to secure the incomplete receiver 10 with the first side panel 75 and the second side panel 80. According to some embodiments, the first side panel 75 and the second side panel 80 comprise trigger through-holes 95 configured to align with a respective trigger through-holes 45 of the incomplete receiver 10 whereby the pin 46 is inserted into and passes within each trigger through-holes 45, 95 to secure the incomplete receiver 10 with the first side panel 75 and the second side panel 80. According to some embodiments, the first side panel 75 and the second side panel 80 comprise hammer through-holes 100 configured to align with a respective hammer through-holes 50 of the incomplete receiver 10 whereby the pin 51 is inserted into and passes within each hammer through-holes 50, 100 to secure the incomplete receiver 10 with the first side panel 75 and the second side panel 80.

According to some embodiments, the incomplete receiver 10 comprises one or more protrusions 105 in the opening 20. According to some embodiments, one or both inner surfaces of the opening 20 comprise the one or more protrusions 105. According to some embodiments, the first side panel 75 and/or the second side panel 80 comprise one or more through-holes 110 shaped to match the one or more protrusions 105. According to some embodiments, the one or more through holes 110 lineup with and interlock with the one or more protrusions 105 when the first side panel 75 and/or the second side panel 80 are placed in the opening 20.

According to some embodiments, combination of the incomplete receiver 10 and the buffer tube insert 60 forms a complete receiver 115 shown in FIG. 3.

According to some embodiments presently disclosed, the incomplete receiver 10 comprises a first material having a first melting point and the buffer tube insert 60 comprises a second material having a second melting point.

Figure 4:
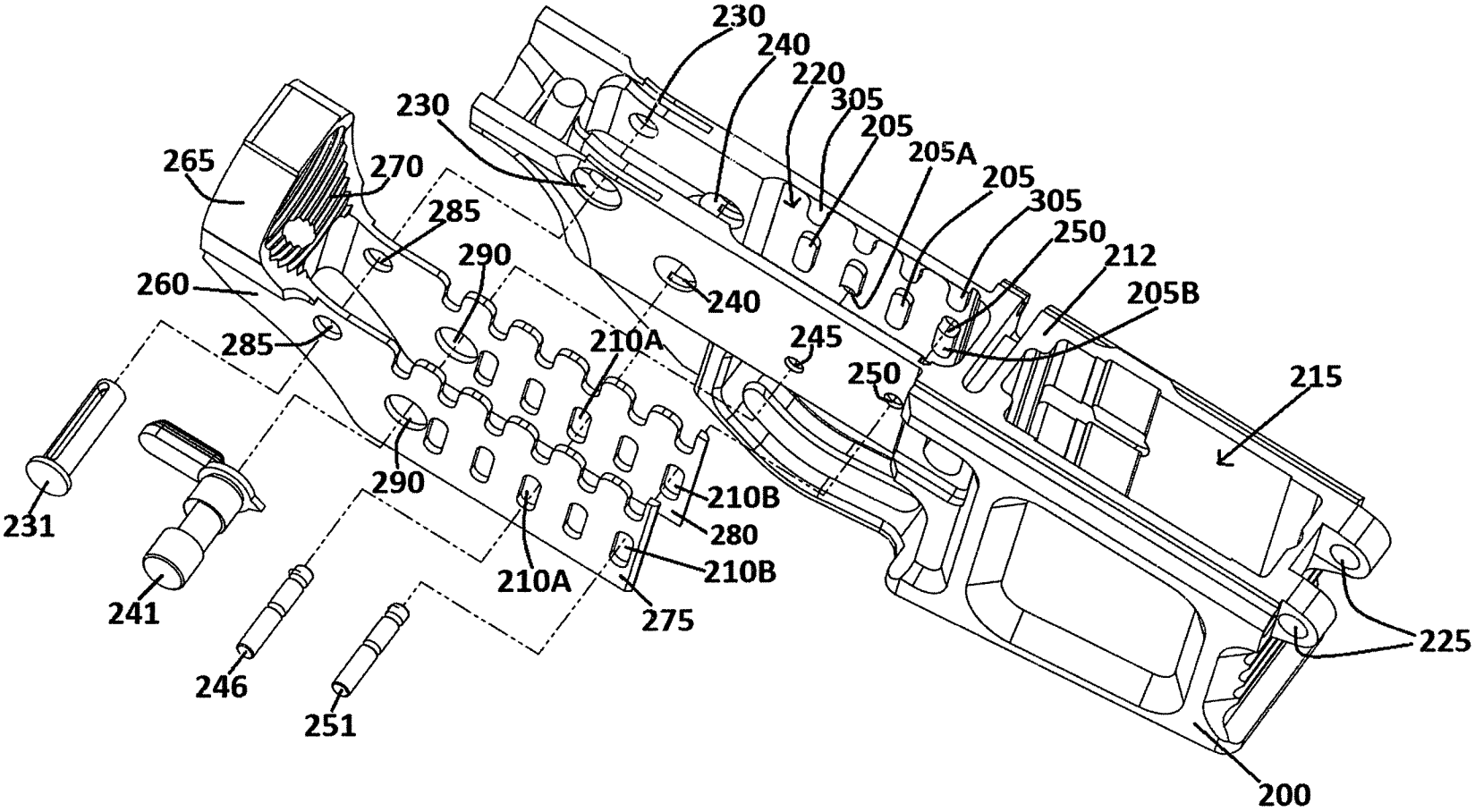
FIG. 4 depicts an exploded view of another incomplete receiver and another buffer tube insert according to the present disclosure.

Referring to FIG. 4, an incomplete receiver 200 for a firearm is shown according to the present disclosure. The incomplete receiver 200 may comprise a generally flat top surface 212 configured with openings for accepting the internal mechanisms required to operate the rifle. For example, the incomplete receiver 200 may comprise an opening 215 configured to accept an ammunition magazine (not shown) and associated hardware to direct rounds loaded within the magazine into a chamber in an upper receiver (not shown). The incomplete receiver 200 may also comprise an opening 220. According to some embodiments, the opening 220 is too large to accommodate a standard firing mechanism (i.e. standard trigger group). According to some embodiments, the standard firing mechanism (i.e. standard trigger group) comprises a trigger mechanism and a hammer mechanism.

According to some embodiments, the incomplete receiver 200 comprises through-holes 225 configured to align with a respective through-holes of an upper receiver (not shown) whereby a pin is inserted into and passes within each through-hole to secure the incomplete receiver 200 with the upper receiver (not shown). According to some embodiments, the incomplete receiver 200 comprises through-holes 230 configured to align with a respective through-holes of an upper receiver (not shown) whereby a pin 231 (shown in FIG. 4) is inserted into and passes within each through-hole to secure the incomplete receiver 200 with the upper receiver (not shown).

According to some embodiments, the incomplete receiver 200 comprises safety-selector through-holes 240 whereby a pin 241 (shown in FIG. 4) is inserted into and passes within the safety-selector through-holes 240 to secure a safety selector mechanism inside the incomplete receiver 200. According to some embodiments, the incomplete receiver 200 comprises trigger through-holes 245 whereby a pin 246 (shown in FIG. 4) is inserted into and passes within the trigger through-holes 245 to secure a trigger mechanism inside the incomplete receiver 200. According to some embodiments, the incomplete receiver 200 comprises hammer through-holes 250 whereby a pin 251 (shown in FIG. 4) is inserted into and passes within the hammer through-holes 250 to secure a hammer mechanism inside the incomplete receiver 200. According to some embodiments, the incomplete receiver 200 comprises a grip mounting surface 235 (shown in FIG. 6) for securing, for example, a pistol grip (not shown).

It is to be understood that the incomplete receiver 200 may be an AR-style lower receiver or any other type of a firearm receiver.

Figure 5:
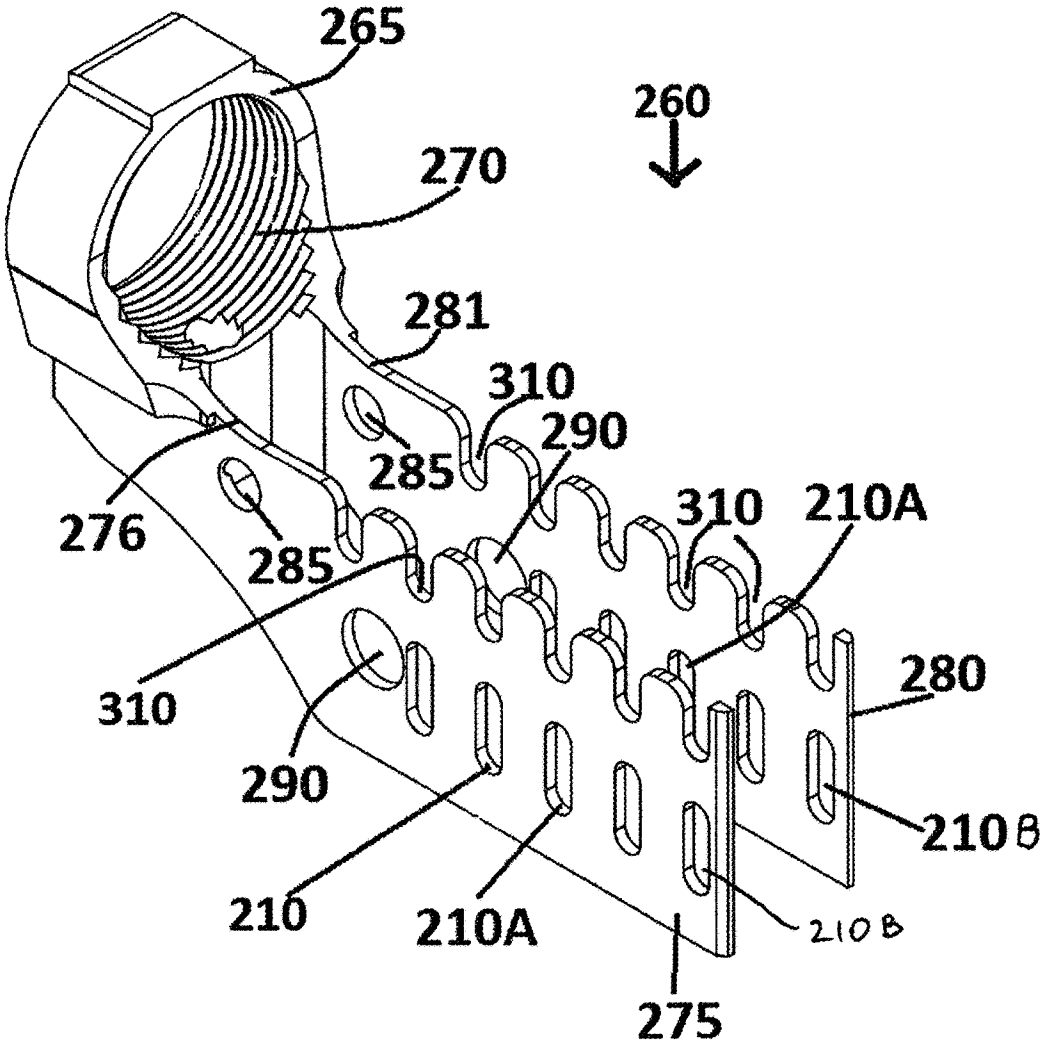
FIG. 5 depicts the buffer tube insert shown in FIG. 4.

Referring to FIGS. 4-5, a buffer tube insert 260 is shown according to the present disclosure. The buffer tube insert 260 comprises an upwardly extending lobe 265. According to some embodiments, the upwardly extending lobe 265 is used to mount a buttstock (not shown) to the buffer tube insert 260 and is used to align a receiver extension (not shown) with a bolt carrier housed within an upper receiver (not shown). The receiver extension (not shown) generally houses an action (or recoil) spring and a buffer assembly (not shown). Upon discharge of a round, the bolt carrier within the upper housing is driven rearward by action of the gas discharged by the firing action. The buffer assembly and action spring dampen the kickback experienced by a user while also redirecting the firing mechanism back toward the chamber in preparation for firing another round.

According to some embodiments, the upwardly extending lobe 265 comprises a generally circular threaded through-hole 270 adapted to receive the mating male threads on the receiver extension (not shown).

According to some embodiments, the buffer tube insert 260 comprises a first side panel 275 and a second side panel 280. According to some embodiments, the upwardly extending lobe 265 is coupled with the first side panel 275 and the second side panel 280. According to some embodiments, the upwardly extending lobe 265 is integrally coupled with the first side panel 275 and the second side panel 280. According to some embodiments, the upwardly extending lobe 265 is substantially perpendicular to the first side panel 275 and the second side panel 280. According to some embodiments, the upwardly extending lobe 265 forms a generally 90 degree elbow with the first side panel 275 and the second side panel 280.

According to some embodiments, the first side panel 275 and the second side panel 280 are a first distance apart. According to some embodiments, the first distance is sufficient enough to accommodate a standard firing mechanism (i.e. standard trigger group).

According to some embodiments, the first side panel 275 comprises a generally flat top surface 276. According to some embodiments, the second side panel 280 comprises a generally flat top surface 281.

Figure 6:
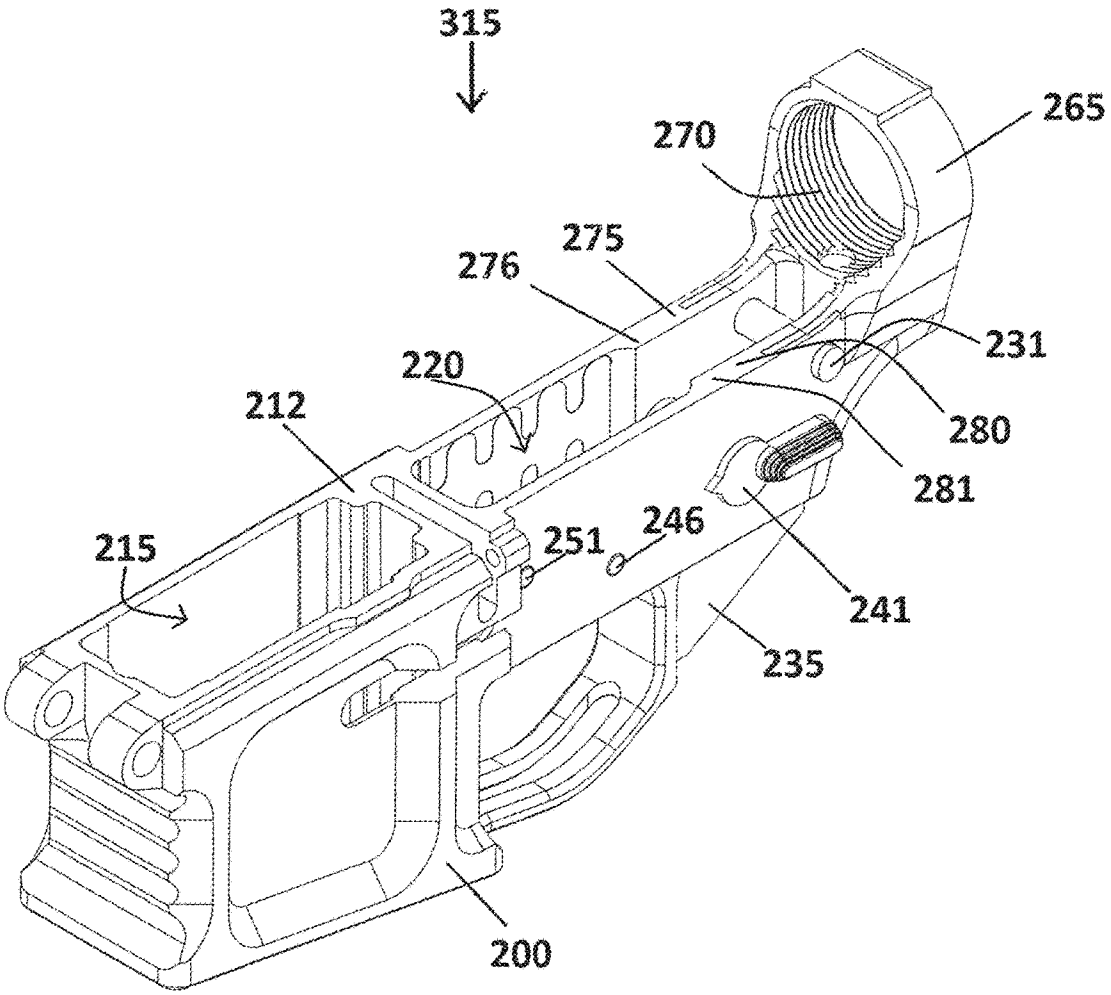
FIG. 6 depicts the incomplete receiver shown in FIG. 4 coupled with the buffer tube insert shown in FIG. 4.

According to some embodiments, the opening 220 is configured to accommodate the first side panel 275 and the second side panel 280 as shown in FIG. 6. According to some embodiments, the flat top surface 276 and the flat top surface 281 lineup with the top surface 212.

According to some embodiments, the first side panel 275 and the second side panel 280 comprise through-holes 285 configured to align with a respective through-holes 230 of the incomplete receiver 200 whereby the pin 231 is inserted into and passes within each through-hole 230, 285 to secure the incomplete receiver 200 with the first side panel 275 and the second side panel 280. According to some embodiments, the first side panel 275 and the second side panel 280 comprise safety-selector through-holes 290 configured to align with a respective safety-selector through-holes 240 of the incomplete receiver 200 whereby the pin 241 is inserted into and passes within each safety-selector through-holes 4240, 290 to secure the incomplete receiver 200 with the first side panel 275 and the second side panel 280.

According to some embodiments, the incomplete receiver 200 comprises one or more protrusions 205 in the opening 220. According to some embodiments, one or both inner surfaces of the opening 220 comprise the one or more protrusions 205. According to some embodiments, the first side panel 275 and/or the second side panel 280 comprise one or more through-holes 210 shaped to match the one or more protrusions 205. According to some embodiments, the one or more through holes 210 lineup with and interlock with the one or more protrusions 205 when the first side panel 275 and/or the second side panel 280 are placed in the opening 220.

According to some embodiments, the incomplete receiver 200 comprises one or more protrusions 305 in the opening 220. According to some embodiments, one or both inner surfaces of the opening 220 comprise the one or more protrusions 305. According to some embodiments, the flat top surface 276 and/or the flat top surface 281 comprise one or more channels 310 shaped to match the one or more protrusions 305. According to some embodiments, the one or more channels 310 lineup with and accommodate the one or more protrusions 305 when the first side panel 275 and/or the second side panel 280 are placed in the opening 220.

Figure 7:
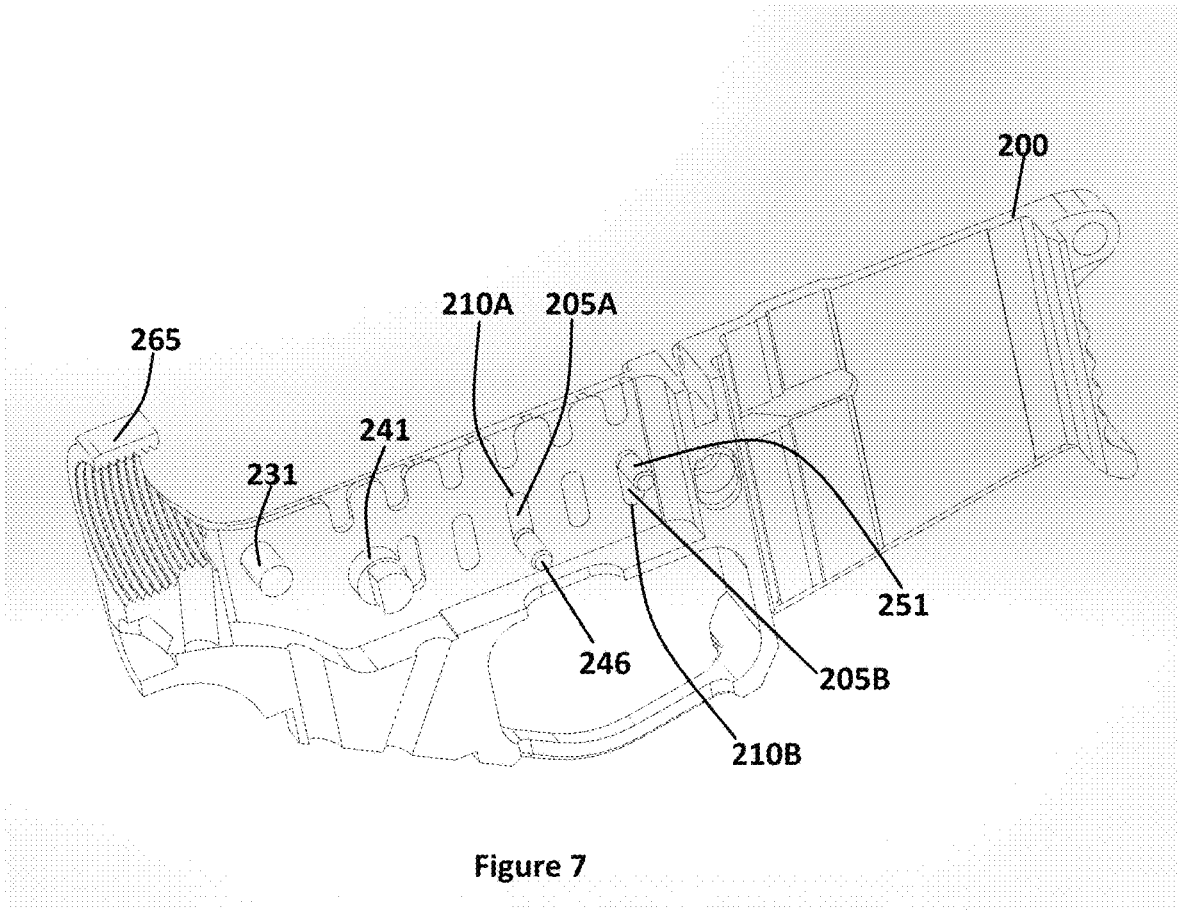
FIG. 7 depicts a cross section of the incomplete receiver shown in FIG. 6 coupled with the buffer tube insert shown in FIG. 6.

According to some embodiments, the trigger through-holes 245 is formed through the protrusion 205A as shown in FIG. 4. According to some embodiments, the through holes 210A of the first side panel 275 and the second side panel 280 are configured to align with the trigger through-holes 245 of the incomplete receiver 200 whereby the pin 246 is inserted into and passes within the through holes 210A, the trigger through-holes 245, and the protrusions 205A to secure the incomplete receiver 200 with the first side panel 275 and the second side panel 280. According to some embodiments, the pin 246 is wedged between the protrusion 205A and the through hole 210A (shown in FIG. 7 representing a cutaway view of the incomplete receiver 200). According to some embodiments, a portion of the pin 246 is supported only by the protrusion 205A (shown in FIG. 7 representing a cutaway view of the incomplete receiver 200)

According to some embodiments, the hammer through-holes 250 is formed through the protrusion 205B as shown in FIG. 4. According to some embodiments, the through holes 210B of the first side panel 275 and the second side panel 280 are configured to align with the hammer through-holes 250 of the incomplete receiver 200 whereby the pin 251 is inserted into and passes within the through holes 210B, the hammer through-holes 250, and the protrusions 205B to secure the incomplete receiver 200 with the first side panel 275 and the second side panel 280. According to some embodiments, the pin 251 is wedged between the protrusion 205B and the through hole 210B (shown in FIG. 7 representing a cutaway view of the incomplete receiver 200). According to some embodiments, a portion of the pin 251 is supported only by the protrusion 205B (shown in FIG. 7 representing a cutaway view of the incomplete receiver 200)

According to some embodiments, combination of the incomplete receiver 200 and the buffer tube insert 260 forms a complete receiver 315 shown in FIG. 6.

According to some embodiments presently disclosed, the incomplete receiver 200 comprises a first material having a first melting point and the buffer tube insert 260 comprises a second material having a second melting point.

According to some embodiments presently disclosed, the first material is steel, aluminum, metal, polymer, and/or sintered metal powder. According to some embodiments presently disclosed, the second material is steel, aluminum, metal, polymer, and/or sintered metal powder. According to some embodiments presently disclosed, the first melting point is lower than the second melting point.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . ."

What is claimed is:

1. A receiver comprising:

an incomplete receiver comprising:

a first receiver opening configured to accommodate an ammunition magazine;

a second receiver opening comprising a first and a second protrusion;

a buffer tube insert comprising:

an upwardly extending lobe;

a first side panel positioned within the second receiver opening, the first side panel comprising a first panel opening configured to accommodate the first protrusion;

a second side panel positioned within the receiver second opening, the second side panel comprising a second panel opening configured to accommodate the second protrusion.

2. The receiver of claim 1 further comprising:

one or more pins removably coupling the incomplete receiver with the first side panel and the second side panel.

3. The receiver of claim 2, wherein the one or more pins removably couple the incomplete receiver with an upper receiver.

4. The receiver of claim 2, wherein the one or more pins are wedged between an opening in the first protrusion and the first panel opening.

5. The receiver of claim 4, wherein the one or more pins are also wedged between another opening in the second protrusion and the second panel opening.

6. The receiver of claim 2, wherein the one or more pins are disposed between a first opening in the incomplete receiver and the first panel opening.

7. The receiver of claim 6, wherein the one or more pins are also disposed between a second opening in the incomplete receiver and the second panel opening.

8. A method comprising:

providing an incomplete receiver comprising:

a first receiver opening configured to accommodate an ammunition magazine;

a second receiver opening comprising a first and a second protrusion;

providing a buffer tube insert comprising:

an upwardly extending lobe;

a first side panel comprising a first panel opening configured to accommodate the first protrusion;

a second side panel comprising a second panel opening configured to accommodate the second protrusion;

positioning the first side panel and the second side panel within the second receiver opening;

positioning the first protrusion within the first panel opening; and positioning the second protrusion within the second panel opening.

9. The method of claim 1 further comprising:

providing one or more pins;

securing the incomplete receiver with the first side panel and the second side panel using the one or more pins.

* * * * *